US010362888B1

(12) United States Patent
Barcohana

(10) Patent No.: US 10,362,888 B1
(45) Date of Patent: Jul. 30, 2019

(54) POSTURE IMPROVEMENT PILLOW

(71) Applicant: Babak Barcohana, Van Nuys, CA (US)

(72) Inventor: Babak Barcohana, Van Nuys, CA (US)

( * ) Notice: Subject to any disclaimer, the term of this patent is extended or adjusted under 35 U.S.C. 154(b) by 0 days.

(21) Appl. No.: 15/705,002

(22) Filed: Sep. 14, 2017

(51) Int. Cl.
*A47G 9/10* (2006.01)
*A61H 1/02* (2006.01)

(52) U.S. Cl.
CPC ..... *A47G 9/109* (2013.01); *A47G 9/1036* (2013.01); *A61H 1/0296* (2013.01); *A47G 2009/1018* (2013.01)

(58) Field of Classification Search
CPC ..... A47G 9/10; A47G 9/1009; A47G 9/1036; A47G 9/1054; A47G 9/1072; A47G 9/1081; A47G 9/109; A47G 2009/1018; A61H 1/0296; A61H 1/0292
See application file for complete search history.

(56) References Cited

U.S. PATENT DOCUMENTS

D399,675 S 10/1998 Ferris
6,003,177 A 12/1999 Ferris
6,006,381 A * 12/1999 Tandrup ..... A47D 13/08 5/637
D418,711 S 1/2000 Mettler
D434,936 S 12/2000 May
6,922,860 B2 8/2005 Cuddy
7,165,279 B1 1/2007 Georgescu
D541,096 S 4/2007 Georgescu
D576,438 S 9/2008 Peart
7,437,788 B1 10/2008 Holman
2012/0186022 A1 7/2012 Navarro
2015/0257554 A1* 9/2015 Ross ..... A47C 27/086 5/639
2018/0042410 A1* 2/2018 Garfield ..... A47G 9/1081

* cited by examiner

*Primary Examiner* — Eric J Kurilla
(74) *Attorney, Agent, or Firm* — Thomas I. Rozsa

(57) ABSTRACT

A therapeutic pillow for improving the posture of a person and to add comfort to a person's neck and back when in use. The therapeutic pillow provides a central pouch for storing a heat pack to promote healing or cool pack to reduce swelling. Additional feature of the therapeutic include a unique, ergonomic shape with specifically located curvilinear cutouts within the shape of the pillow to provide benefits to the user. Cutouts within the shape of the pillow provide the user with a location to breath more easily. These same cutouts when the pillow is placed in a different position relative to the user will allow the user's eyes to not be pressed against the pillow when in use. When a user's eyes are not pressed against a pillow, a user's eyes will show less wrinkles commonly known as crow's feet.

15 Claims, 36 Drawing Sheets

POSTURE IMPROVEMENT PILLOW

BACKGROUND OF THE INVENTION

1. Field of the Invention

The present invention relates to the field of pillows. Specifically, the present invention relates to therapeutic pillows for the purposes of improved posture and promotion of healing.

2. Description of the Prior Art

The following 11 patents and published patent applications are the closest prior art known to the inventor:

1. U.S. Design Pat. No. 399,675 issued to Robyn Wendy Ferris on Oct. 20, 1998 for "Pillow" (hereafter the "Ferris Design Patent");
2. U.S. Pat. No. 6,003,177 issued to Robyn Wendy Ferris on Dec. 21, 1999 for "Pillow" (hereafter the "Ferris Utility Patent");
3. U.S. Pat. No. 6,006,381 issued to Laurie Lynne Tandrup on Dec. 28, 1999 for "Support Pillow" (hereafter the "Tandrup Patent");
4. U.S. Design Pat. No. 418,711 issued to Paul R. Mettler on Jan. 11, 2000 for "Neck Support Pillow" (hereafter the "Mettler Design Patent");
5. U.S. Pat. No. Des. 434,936 issued to Linda May on Dec. 12, 2000 for "Face Pillow" (hereafter the "May Design Patent");
6. U.S. Pat. No. 6,922,860 issued to Robert B. Cuddy on Aug. 2, 2005 for "Head Cradle with Body Support" (hereafter the Cuddy Patent");
7. U.S. Pat. No. 7,165,279 issued to Daniela Georgesen on Jan. 23, 2007 for "Facial Beauty Pillow" (hereafter the "Georgesen Patent");
8. U.S. Design Pat. No. D541,096 issued to Daniela Georgesen on Apr. 24, 2007 for "Pillow" (hereafter the "Georgesen Design Patent");
9. U.S. Design Pat. No. D576,438 issued to Margaret Ann Peart on Sep. 9, 2008 for "Side Sleeper Pillow" (hereafter the "Peart Design Patent");
10. U.S. Pat. No. 7,437,788 issued to Elward L. Holman on Oct. 21, 2008 for "Pillow" (hereafter the "Holman Patent");
11 United States Published Patent Application No. 2012/0186022 to Nancy Navarro on Jul. 26, 2012 for "Pillow" (hereafter the "Navarro Published Patent Application").

The Ferris Design Patent protects the shape and appearance of the pillow.

The Ferris Utility Patent discloses a pillow which comprises a central portion having a pair of head support limbs which curve outwardly from the head end of the pillow towards a foot end of the pillow. A pair of neck, chin and jaw support limbs extend outwardly at the foot end and inwardly of the head support limbs. The limbs are provided with curved, concave surfaces and define air breathing spaces between the limbs.

The Tandrup Patent discloses a pillow in the general shape of a butterfly.

The Mettler Design Patent protects the shape of the pillow.

The May Design Patent protects the shape of the pillow.

The Cuddy Patent discloses an apparatus for supporting the head of a user while the user is lying in a face-down position, a face-up position or a side position.

The Georgesen Utility Patent discloses an apparatus for supporting the head of user while the user is lying in a face-down position, a face-up position or a side position.

The Georgesen Design Patent protects the shape of the pillow.

The Peart Design Patent protects the shape of the pillow.

The Holman Patent discloses a pillow comprising a pillow body having a generally elongated main segment and a pair of spaced-apart extension segments extending from said main segment; a pillow interior defined between said main segment and said extension segments; a pair of pillow arms extending from said pillow body into said pillow interior; and a pair of extension segment protuberances extending from said pair of extension segments, respectively, and a pillow gap defined between said pair of extension segment protuberances and communicating with said pillow interior.

The Navarro Published Patent Application discloses an anti-wrinkle pillow shaped to avoid contact of facial tissues with the pillow surface while sleeping on the side, in combination with pillow extensions that surround the upper body to provide added comfort and support.

SUMMARY OF THE INVENTION

The present invention is a therapeutic pillow for improving the posture of a person and to add comfort to a person's neck and back when in use.

It is an object of the present invention to provide a central pouch for storing a heat pack to promote healing or cool pack to reduce swelling.

It is also an object of the present invention to provide a unique, ergonomic shape with specifically located curvilinear cutouts within the shape of the pillow to provide benefits to the user. Cutouts within the shape of the pillow provide the user with a location to breath more easily. These same cutouts when the pillow is placed in a different position relative to the user will allow the user's eyes to not be pressed against the pillow when in use. When a user's eyes are not pressed against a pillow, a user's eyes will show less wrinkles commonly known as "crow's feet".

It is an additional object of the present invention to provide four primary positions for the user to place their head during use of the pillow.

It is a further object of the present invention to provide two elongated leg portions of the pillow that extend down a user's spine to promote healing. These two elongated leg portions have flexibility for the user to place the leg portions to better straddle a user's spine during use. In addition, these two legs extend down the user's back to expand the chest and improve spinal alignment.

It is still a further object of the present invention to provide an inner material to the pillow which expands and contracts at a preferred distance to promote healing while still providing adequate neck and back support.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DETAILED DESCRIPTION OF EMBODIMENTS OF THE PRESENT INVENTION

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Figure 1:
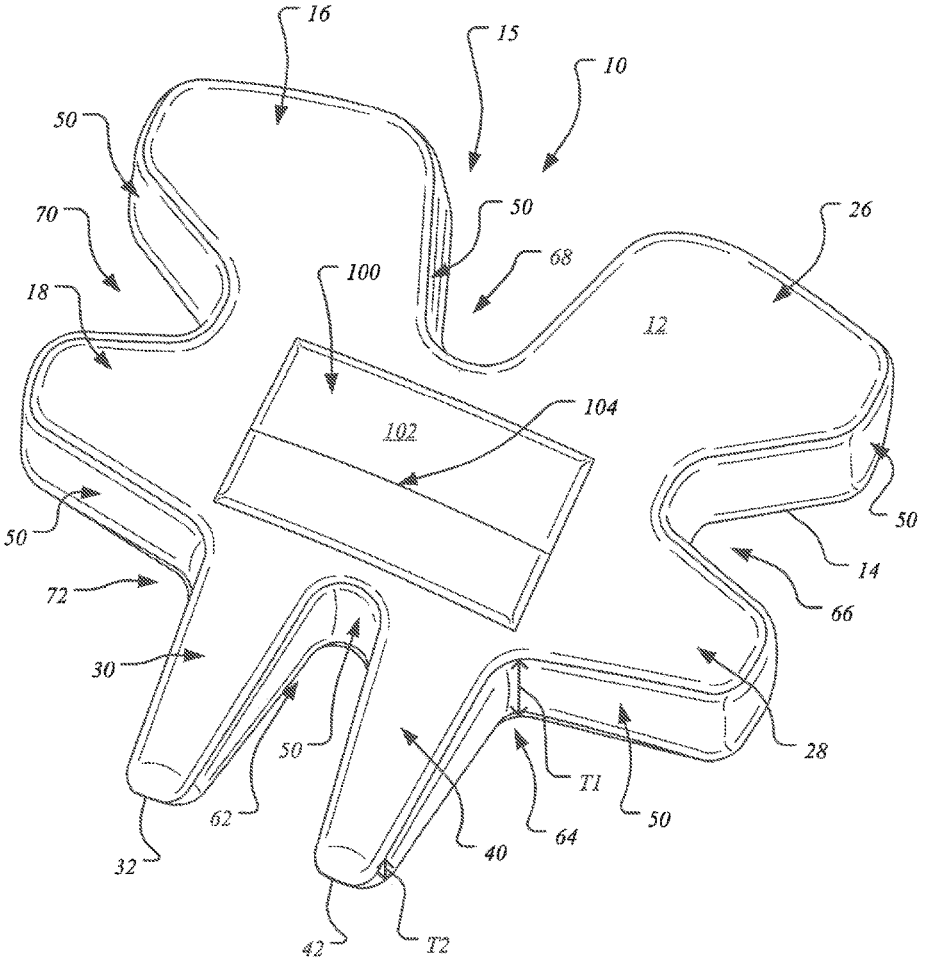
FIG. 1 is a top front perspective view of a first embodiment of the posture improvement pillow with legs, including an optional pocket.

Referring to FIG. 1, there is illustrated a top front perspective view of the first embodiment of the posture improvement pillow 10 with a symmetrically shaped body 15 having a top surface 12, a bottom surface 14 (see FIG. 2), a left upper region 16, a left central region 18, a right upper region 26, a right central region 28, a left leg 30, a right leg 40, and a main vertical circumferential end wall 50.

Figure 2:
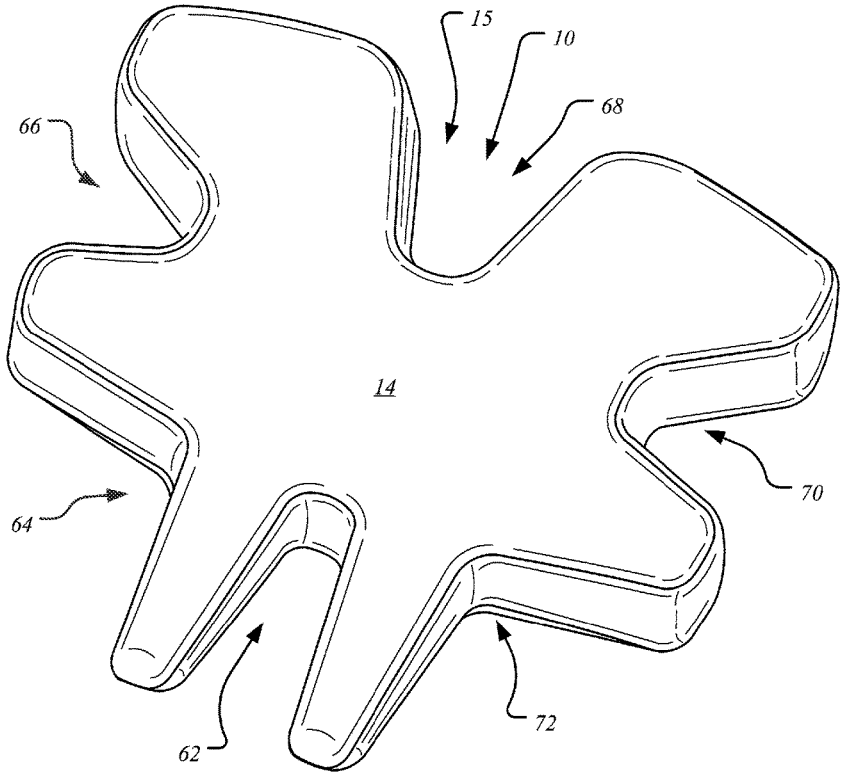
FIG. 2 is a bottom front perspective view of the first embodiment of the posture improvement pillow with legs, including an optional pocket (not visible from bottom)

Referring to FIGS. 1 and 2, the present invention posture improvement pillow 10 also has a symmetrically-shaped body 15 having six contoured cutouts formed into six (6) regions with the main vertical circumferential end wall 50 having a uniform height between the upper surface 12 and the lower surfaces 14 except for a tapering height along the two legs. The curvilinear path of main vertical circumferential end wall 50 extends between left upper region 16, left central region 18, left leg 30, right leg 40, right central region 28 and right upper region 26.

Referring to FIGS. 1 and 2, left leg 30 and right leg 40 of the present invention are formed from the top surface 12, the bottom surface 14 and main vertical circumferential end wall 50 transitioning from a thickness T1 where the legs 30 and 40 are integral at the body 15 and respectively join the left central region 18 and the right central region 28 to the respective distal end of each leg having a thickness T2. The thickness of T1 is approximately between 1.0 inches and 5.0 inches and the thickness of T2 is approximately 0.5 inches to 0.0 inches or ending generally in a point. This results in the each of the legs having a triangular shaped vertical wall that extends from the top surface of the present invention to the bottom surface. Left leg 30 ends in a left curved distal end 32 and right leg 40 ends in right curved distal end 42. The thickness of the body can be thicker or thinner than the edge of the thickness based upon the amount of filling and location of the filling.

Referring to FIG. 1 and FIG. 2, there is illustrated the present invention improvement pillow 10 having a symmetrically-shaped body 15 with contoured cutouts between contoured regions. Beginning from the front of the present invention between right leg 40 and left leg 30, first contoured cutout 62 located between said left leg 30 and said right leg 40 is generally U shaped. Moving in a counterclockwise direction around the present invention which has the same general shape for the first and second embodiments, the second contoured cutout 64 is generally perpendicular between right leg 40 and right central region 28. The third contoured cutout 66 is between right central region 28 and right upper region 26. The fourth contoured cutout 68 is generally U-shaped and is between right upper region 26 and left upper region 16. Fifth contoured cutout 70 is between left upper region 16 and left central region 18. Lastly, sixth contoured cutout 72 is generally perpendicular and is between left central region 18 and left leg 30.

Further referring to FIG. 1, said top surface 12 has a centrally located pocket 100 having a pocket top surface 102 and a pocket opening 104 with said centrally located pocket 100 sized to receive a heating pack to promote healing or a cold pack to reduce swelling.

Figure 3:
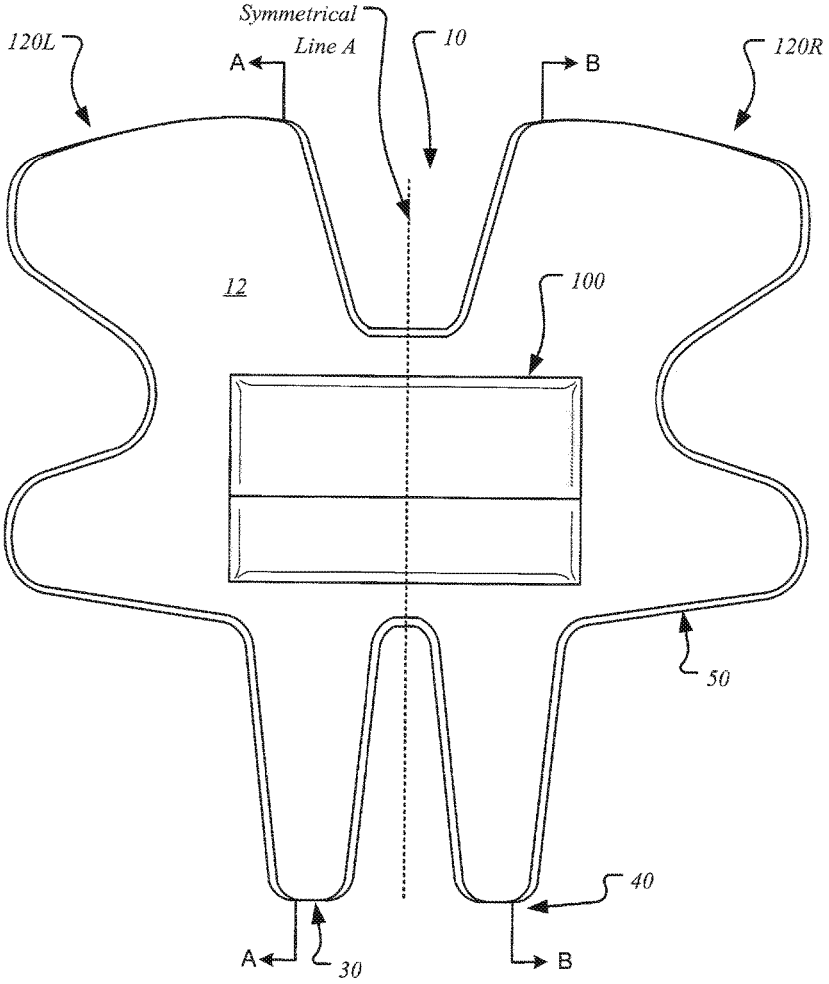
FIG. 3 is a top view of the first embodiment of the posture improvement pillow with legs, including an optional pocket.

Referring to FIG. 3, there is illustrated a top view of the posture improvement pillow 10 having a top surface 12, legs 30 and 40, main vertical circumferential end wall 50, and pocket 100. Also illustrated in FIG. 3 is symmetrical Line A which splits the left and right portions of the posture improvement pillow 10 into two mirror image sections 120L and 120R. Left section 120L is a symmetrical mirror image of right section 120R.

Figure 4:
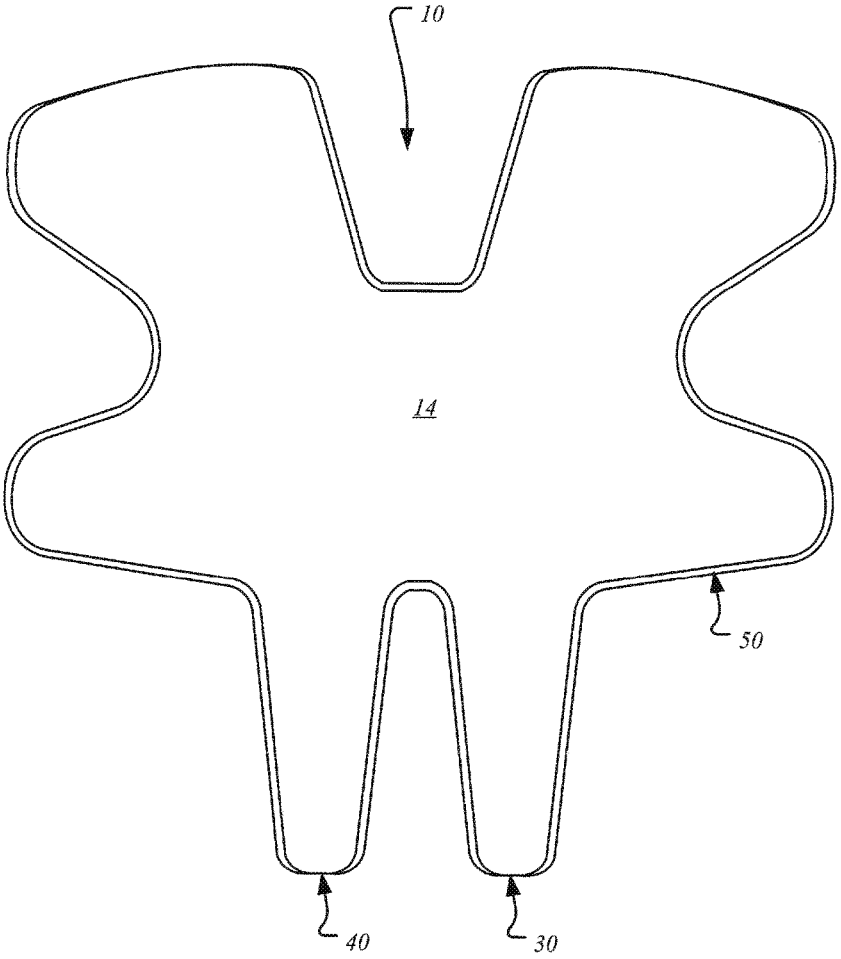
FIG. 4 is a bottom view of the first embodiment of the posture improvement pillow with legs, including an optional pocket (not visible from bottom)

Referring to FIG. 4 there is illustrated a bottom view of the present invention posture improvement pillow 10 having a bottom surface 14, legs 30 and 40, and main vertical circumferential end wall 50.

Figure 5:
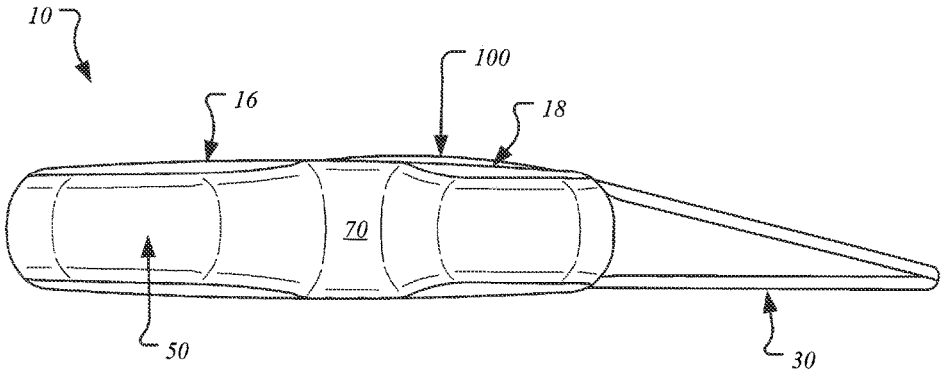
FIG. 5 is a left side view of the first embodiment of the posture improvement pillow with legs, including an optional pocket.

Referring to FIG. 5 there is illustrated a left side view of the first embodiment of the present invention posture improvement pillow 10 with left leg 30, fifth contoured cutout 70, left upper region 16, left central region 18, pocket 100 and main vertical circumferential end wall 50.

Figure 6:
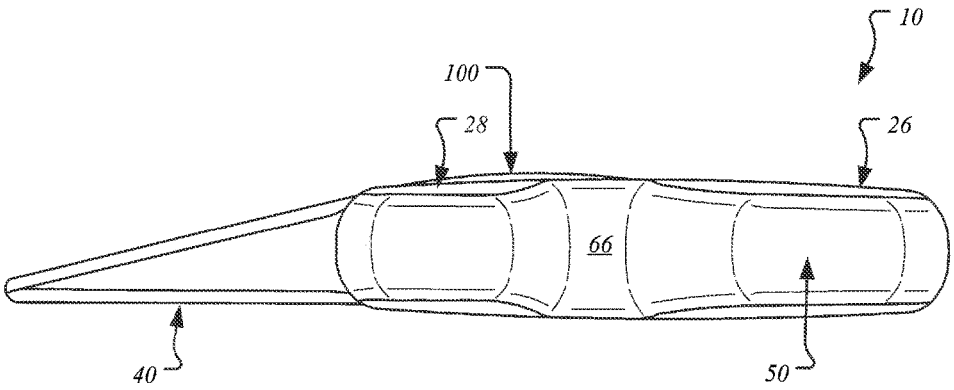
FIG. 6 is a right side view of the first embodiment of the posture improvement pillow with legs, including an optional pocket.

Referring to FIG. 6 there is illustrated a right side view of the first embodiment of the present invention posture improvement pillow 10 with leg 40, third contoured cutout 66, right upper region 26, right central region 28, pocket 100 and main vertical circumferential end wall 50.

Figure 7:
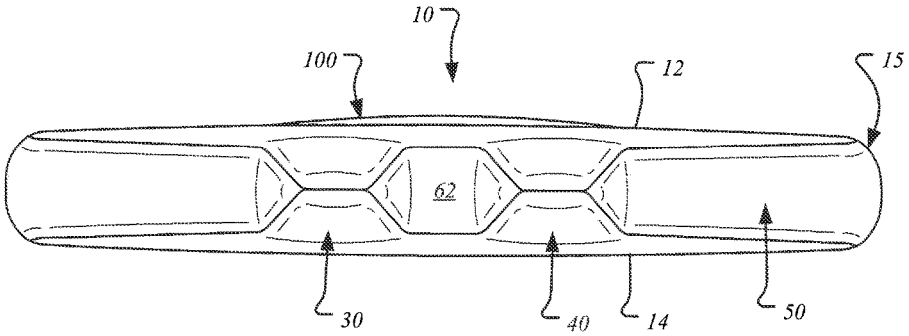
FIG. 7 is a front view of the first embodiment of the posture improvement pillow with legs, including an optional pocket.

Referring to FIG. 7 is a front view of the present invention posture improvement pillow 10 having a top surface 12, a bottom surface 14, legs 30 and 40, first contoured cutout 62, including pocket 100, and illustrating main vertical circumferential end wall 50 that surrounds symmetrically shaped body 15.

Figure 8:
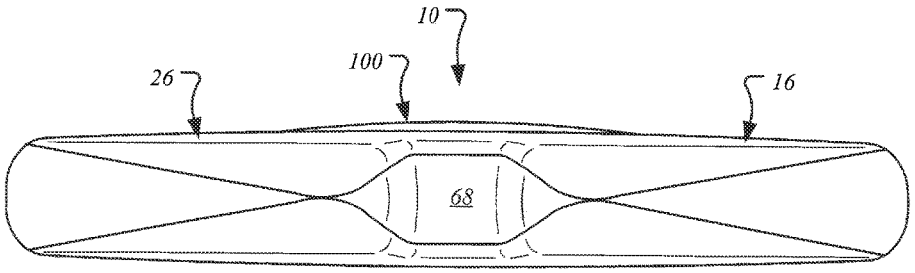
FIG. 8 is a rear view of the first embodiment of the posture improvement pillow with legs, including an optional pocket.

Referring to FIG. 8 there is illustrated a rear view of the present invention posture improvement pillow 10 with pocket 100 and illustrating left upper region 16, right upper region 26, and fourth contoured cutout 68.

Figure 9A:
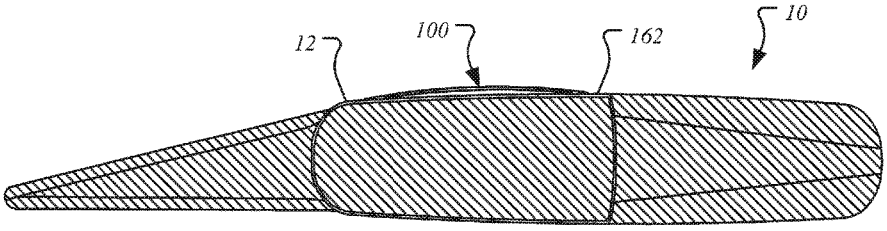
FIG. 9A is a cross sectional view of the posture improvement pillow with legs taken along section A-A of FIG. 3.
Figure 9B:
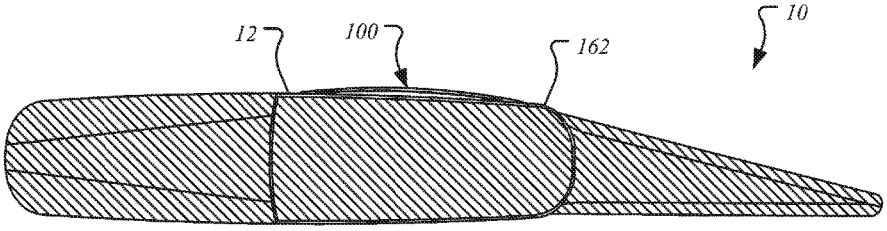
FIG. 9B is a cross sectional view of the posture improvement pillow with legs taken along section B-B of FIG. 3.

Referring to FIGS. 9A and 9B, there is illustrated cross-sectional views of the first embodiment of the posture improvement pillow 10 having a pocket 100 and legs 30 and 40. The interior of the posture improvement pillow 10 is made from a material that is sturdy enough to support the neck and head but compressible to contract and expand when a force such as the weight of a person's head is placed onto the top surface 12. Pillow material 162 can be made of feathers, foam, synthetic foam, gel, latex, polyester, visco-elastic, memory foam, or other common materials used within the pillow industry.

Figure 9C:
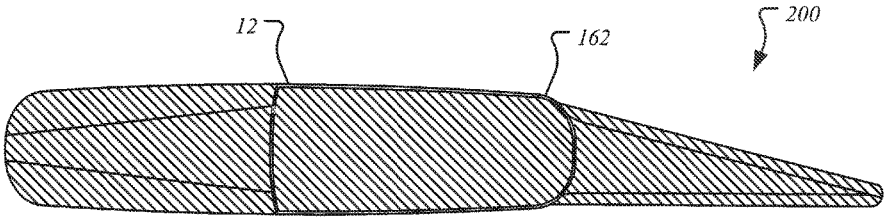
FIG. 9C is a cross sectional view of the second embodiment posture improvement pillow with legs taken along section C-C of FIG. 15.
Figure 9D:
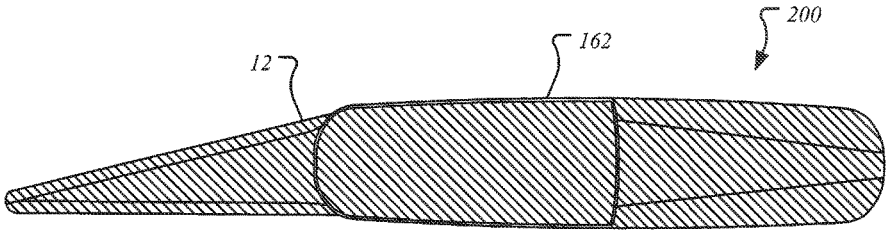
FIG. 9D is a cross sectional view of the second embodiment posture improvement pillow with legs taken along section D-D of FIG. 15.

Referring to FIGS. 9C and 9D, there is illustrated cross-sectional views of the second embodiment of the posture improvement pillow 200, without a pocket, and legs 30 and 40. The interior of the posture improvement pillow 200 is made from a material that is sturdy enough to support the neck and head but compressible to contract and expand when a force such as the weight of a person's head is placed on to top surface 12. Pillow material 162 can be made of feathers, foam, synthetic foam, gel, latex, polyester, visco-elastic, memory foam, or other common materials used within the pillow industry.

Figure 10:
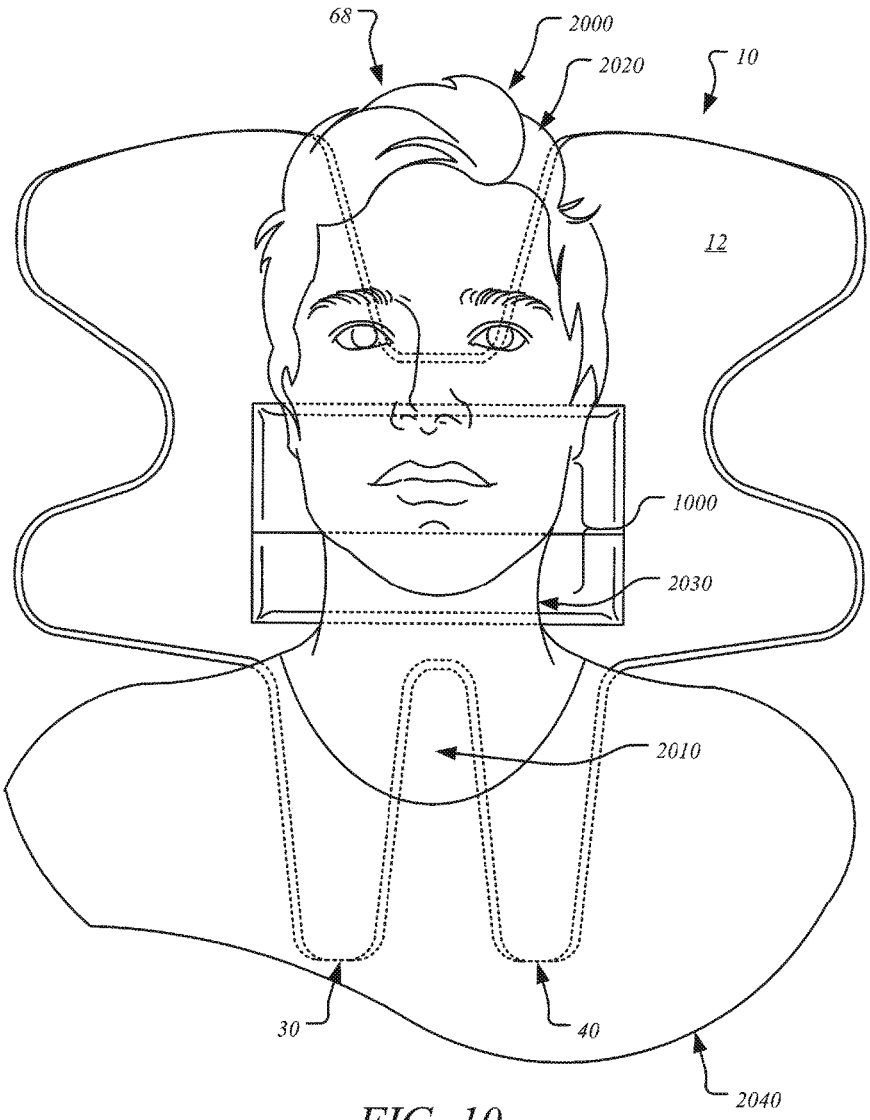
FIG. 10 is a top view of the posture improvement pillow with a user's head centered and resting on the posture improvement pillow and the user laying face up on the posture improvement pillow.

Referring to FIG. 10, there is illustrated a user 2000 lying face up on the present invention posture improvement pillow 10, with the user 2000 having the user's spine 2010 positioned between left leg 30 and right leg 40. Also illustrated in FIG. 10, is the user's head 2020 resting on top surface 12 with a portion of user's head 2020 extending into fourth contoured cutout 68. User's neck 2030 and User's head 2020 are also positioned above pocket 100 to receive the benefits of temperature pack 1000 located inside of pocket 100. During use as illustrated in FIG. 10, user 2000 will receive the heat or cold pack at a desired location along the head or neck and experience the benefits of improved spinal alignment by left leg 30 and right leg 40 that straddle user's spine 2010 and extend down a user's back 2040.

Figure 11:
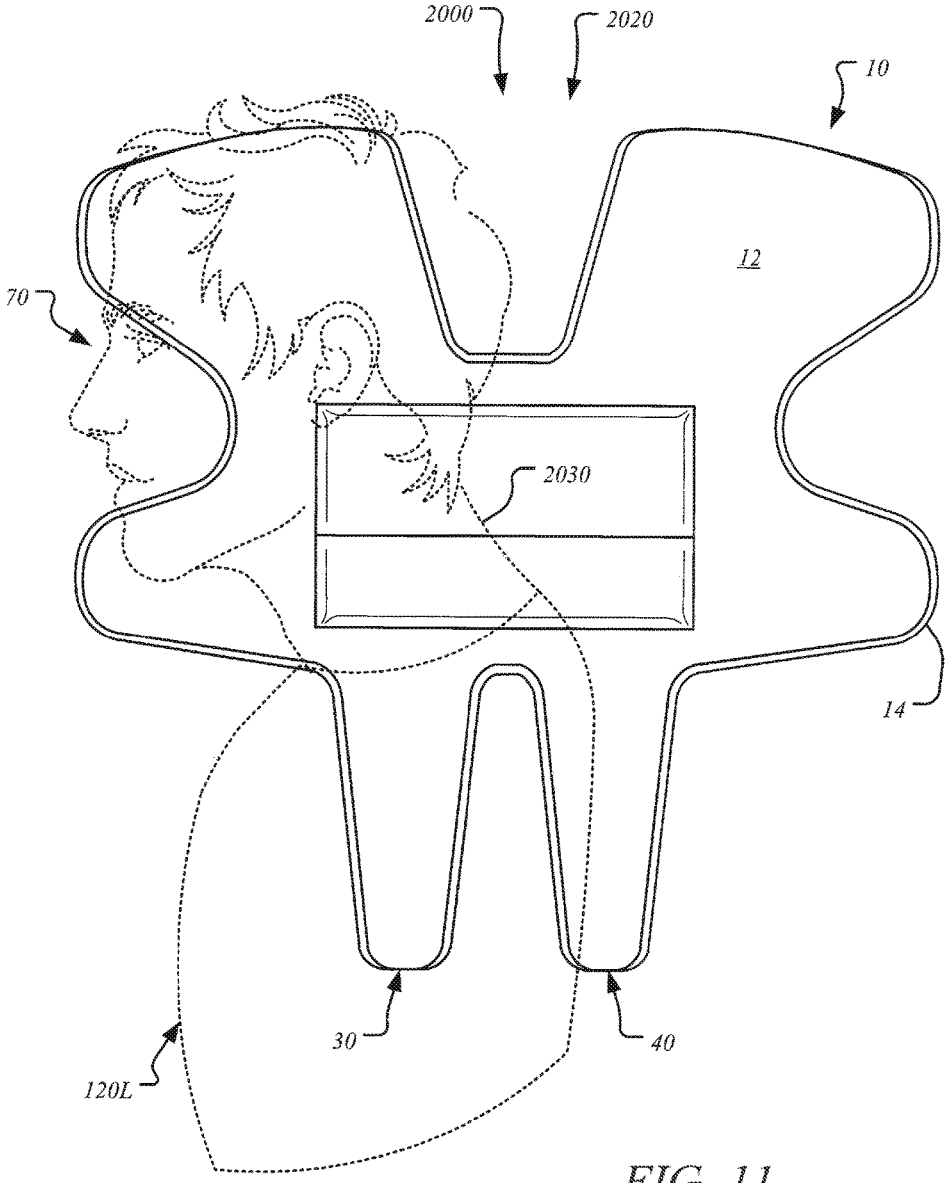
FIG. 11 is a top view of the posture improvement pillow with a user's head positioned off center and resting on the posture improvement pillow and the user's head facing the left region of the posture improvement pillow.

Referring to FIG. 11, a user 2000 is illustrated lying facing the left region of the present invention posture improvement pillow 10, with the user's head 2020 positioned off center and more towards left section 120L of the present invention posture improvement pillow 10. In this position, a user 2000 can rest with their eyes, nose, and mouth positioned within fifth contoured cutout 70 and not touching the top surface 12 of left upper region 16 or left center region 18. By not touching the surfaces of top surface 12, the present invention posture improvement pillow 10 provides support for the head and neck while simultaneously allowing the user to breath easier with the user's mouth and nose positioned off the pillow. Another feature of the present invention in this position is that the user will not have the user's eyes pressed against the pillow during rest which reduces wrinkles around the eyes commonly known as "crows feet". As a result of the cutout other wrinkles and creases are reduced by less pressure being applied to a person's face. Also referring to FIG. 11, in this same off center position, a user can fold legs 30 and 40 underneath the pillow to be adjacent to the bottom surface 14.

Figure 12:
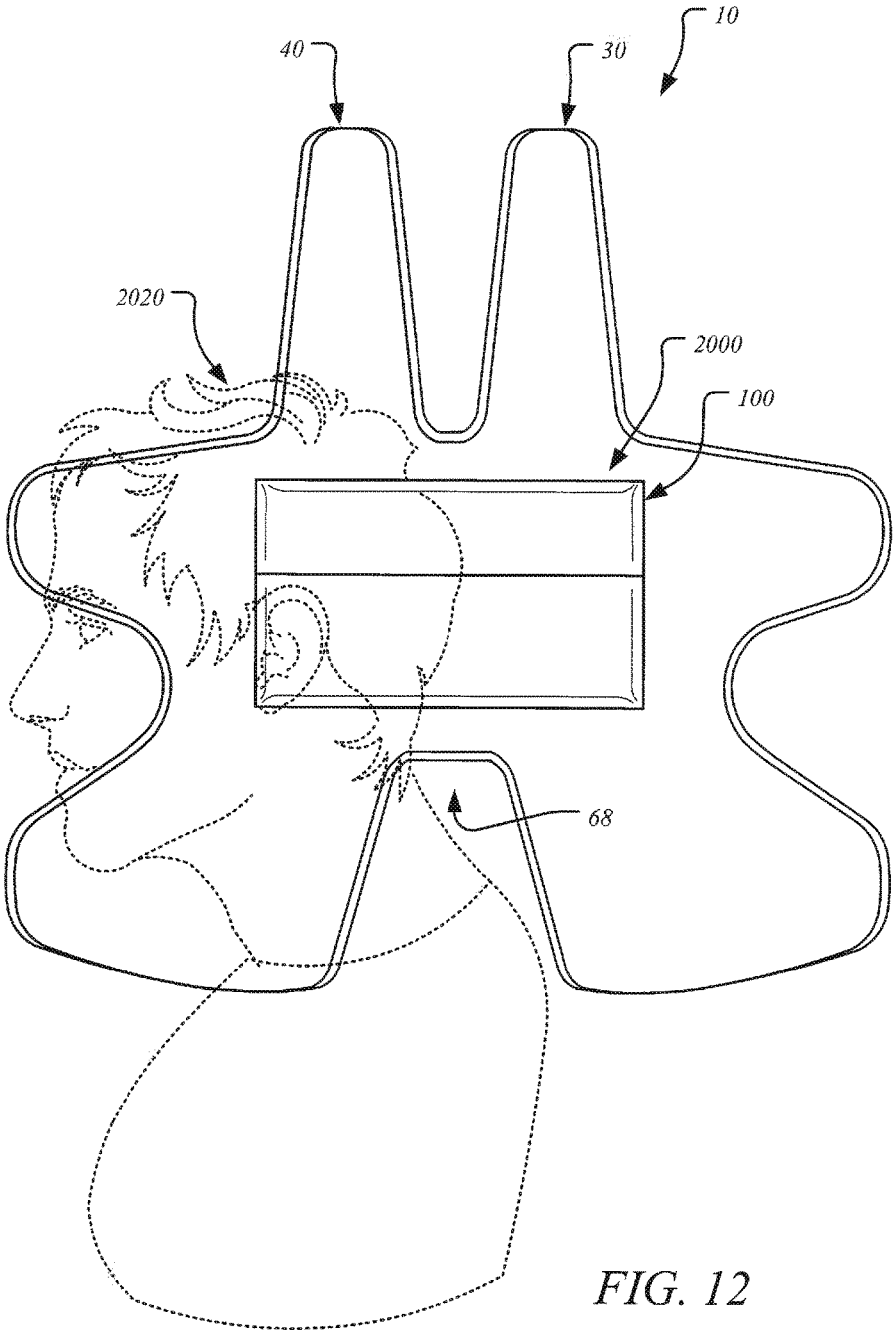
FIG. 12 is a top view of the posture improvement pillow with a user's head positioned off center and the pillow rotated 180 degrees from the view n FIG. 11, the user's head facing away from the legs with the user's head facing the left region of the posture improvement pillow.

Referring to FIG. 12, user 2000 can alternatively place user's head 2020 in the third contoured cutout 66 with a portion of the user's neck 2030 in the fourth contoured cutout 68. In this position legs 30 and 40 are towards the upper portion of user's head 2020 and the legs are not being used to improve spinal alignment. This position is similar to that described in FIG. 11 and allows the user the benefits of improved breathing and less wrinkles. Another benefit to the user utilizing the present invention posture improvement pillow 10 in this position is to take pressure of a person's shoulder and to a keep a person's head in neutral alignment.

Figure 13:
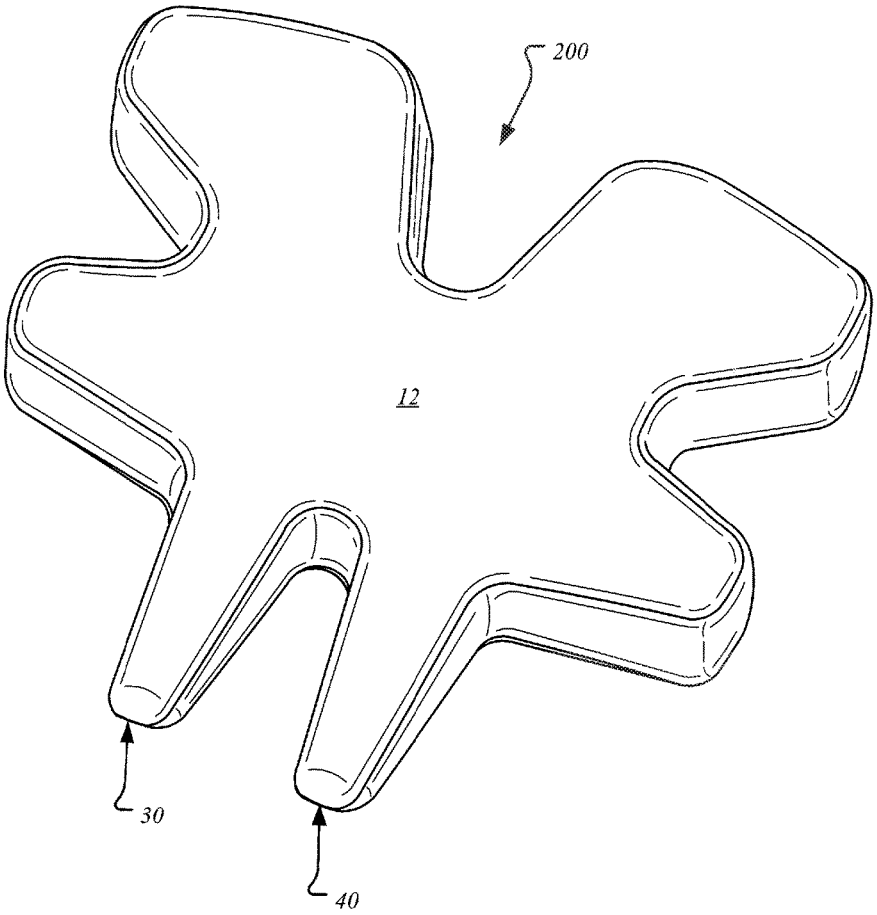
FIG. 13 is a top front perspective view of the second embodiment of the posture improvement pillow with legs, without an optional pocket.
Figure 14:
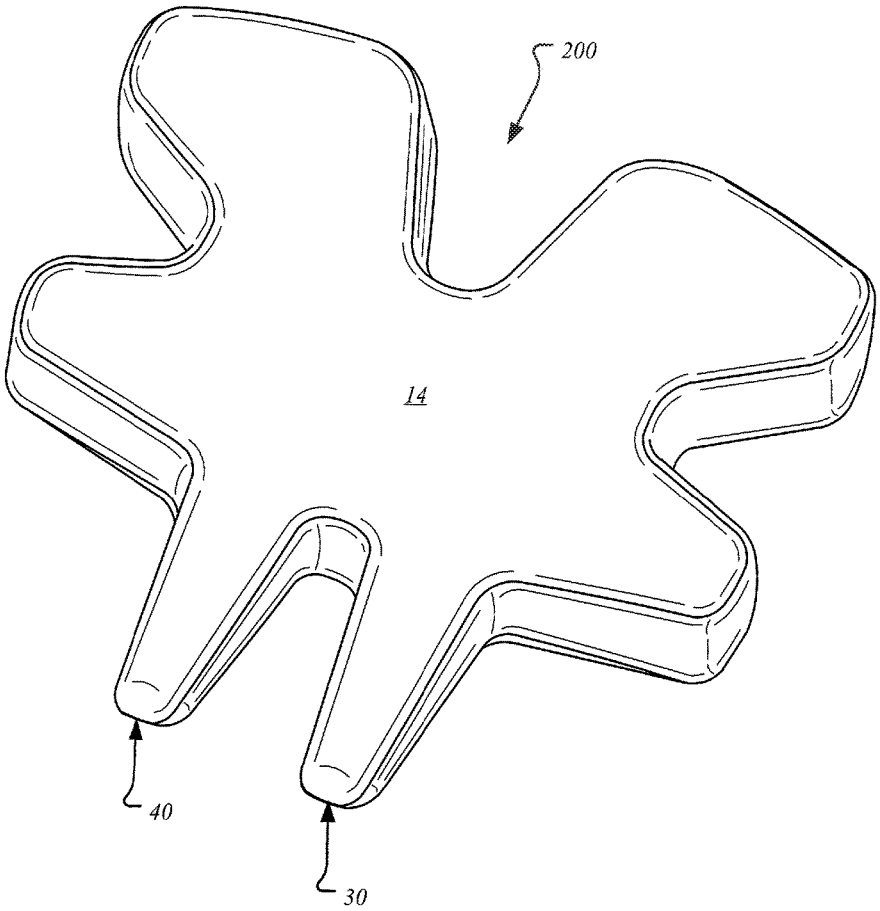
FIG. 14 is a bottom front perspective view of the second embodiment of the posture improvement pillow with legs, without an optional pocket.

FIGS. 13 through 22 illustrate the second embodiment of the present invention. The second embodiment 200 is identical to the first embodiment 10 except that the second embodiment does not contain pocket 100. Since the remaining parts are identical and have identical numbers, the drawings are not numbered but it will be appreciated that FIGS. 13 and 14 are comparable to FIGS. 1 and 2, so that the second embodiment of the present invention posture improvement pillow 10 also has a symmetrically-shaped body 15 having six contoured cutouts formed into six (6) regions with main vertical circumferential end wall 50 having a uniform height between the upper surface 12 and the lower surfaces 14 except for a tapering height along the two legs. The curvilinear path of main vertical circumferential end wall 50 extends between said left upper region 16, said left central region 18, said right upper region 26, said right central region 28, said left leg 30, and said right leg 42.

Since FIGS. 13 and 14 are comparable to FIGS. 1 and 2, left leg 30 and right leg 40 of the present invention are formed from the top surface 12, the bottom surface 14 and main vertical circumferential end wall 50 transitioning from a thickness T1 where the legs 30 and 40 are integral at the body 15 and respectively join the left central region 18 and the right central region 28 to the respective distal end of each leg having a thickness T2. The thickness of T1 is approximately between 1.0 inches and 3.0 inches and the thickness of T2 is approximately 0.5 inches to 0.0 inches or ending generally in a point. This results in the each of the legs having a triangular shaped vertical wall that extends from the top surface of the present invention to the bottom surface. Left leg 30 ends in a left curved distal end 32 and right leg 40 ends in right curved distal end 42.

For the same reason, the identical parts in FIGS. 13 and 14 are numbered the same as FIG. 1 and FIG. 2, so that the second embodiment of the present invention improvement pillow 200 also has a symmetrically-shaped body 15 with contoured cutouts between contoured regions. Beginning from the front of the present invention between right leg 40 and left leg 30, first contoured cutout 62 located between said left leg 30 and said right leg 40 is generally U shaped. Moving in a counterclockwise direction around the present invention which has the same general shape for the first and second embodiments, the second contoured cutout 64 is generally perpendicular between right leg 40 and right central region 28. The third contoured cutout 66 is between right central region 28 and right upper region 26. The fourth contoured cutout 68 is generally wide U-shaped and is between right upper region 26 and left upper region 16. Fifth contoured cutout 70 between left central region 18 and left upper region 16. Lastly, sixth contoured cutout 72 is generally perpendicular between left leg 30 and said left central region 18.

Referring to FIG. 13, there is a second embodiment of the posture improvement pillow 200 illustrating a top front perspective view with legs 30 and 40, having a top surface 12; however in this embodiment, the pocket is removed.

Referring to FIG. 14, there is a second embodiment of the posture improvement pillow 200 illustrating a bottom front perspective view with legs 30 and 40, having a bottom surface 14, however in this embodiment the pocket is removed.

Figure 15:
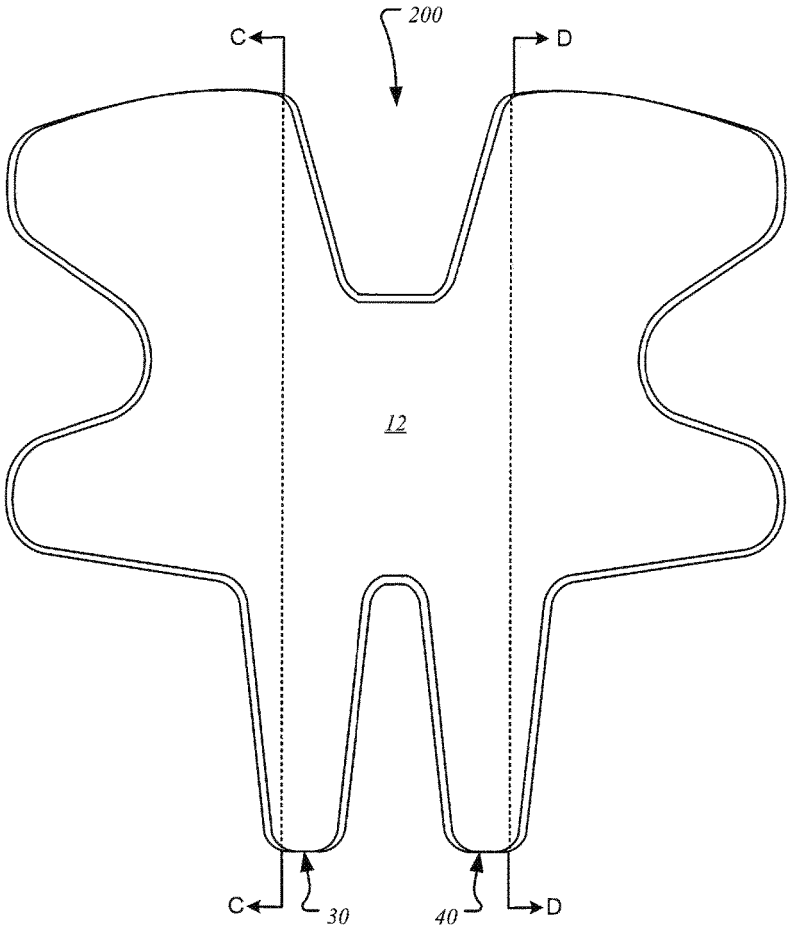
FIG. 15 is a top view of the second embodiment posture improvement pillow with legs, without an optional pocket.

Referring to FIG. 15, there is illustrated the second embodiment of the posture improvement pillow 200 illustrating a top view with legs 30 and 40, having a top surface 12, however in this embodiment the pocket is removed.

Figure 16:
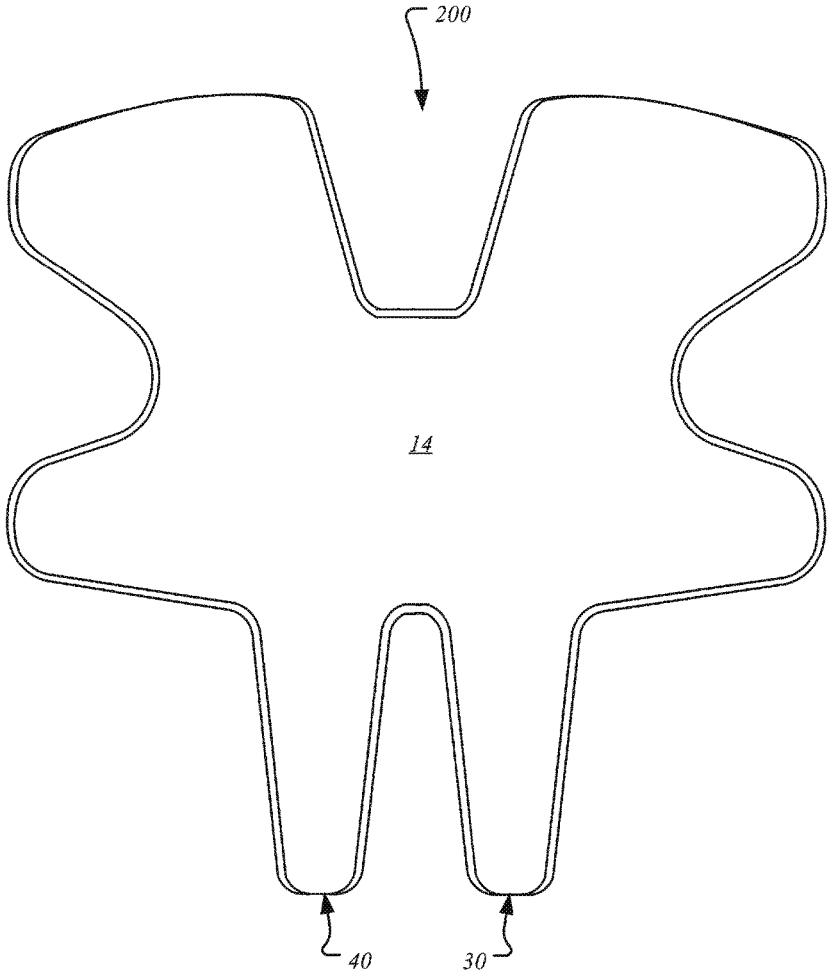
FIG. 16 is a bottom view of the second embodiment posture improvement pillow with legs, without an optional pocket.

Referring to FIG. 16, there is the second embodiment of the posture improvement pillow 200 illustrating a bottom view with legs 30 and 40, having a bottom surface 14, however in this embodiment the pocket is removed.

Figure 17:
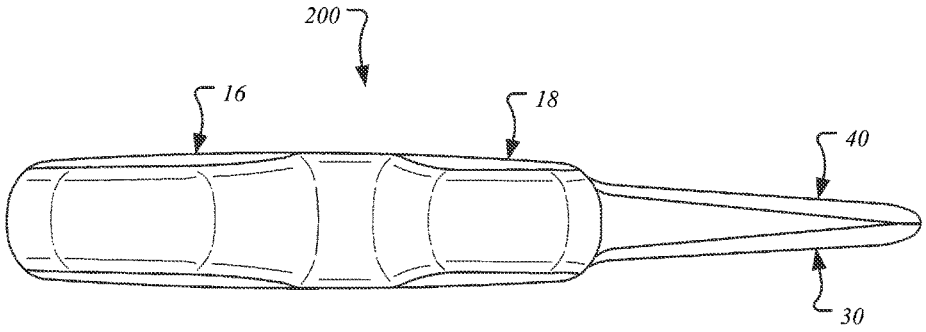
FIG. 17 is a left side view of the second embodiment posture improvement pillow with legs, without an optional pocket.

Referring to FIG. 17, there is illustrated a left side view of the second embodiment of the posture improvement pillow 200 with legs 30 and 40, left upper region 16, and left central region 18 and not having a pocket.

Figure 18:
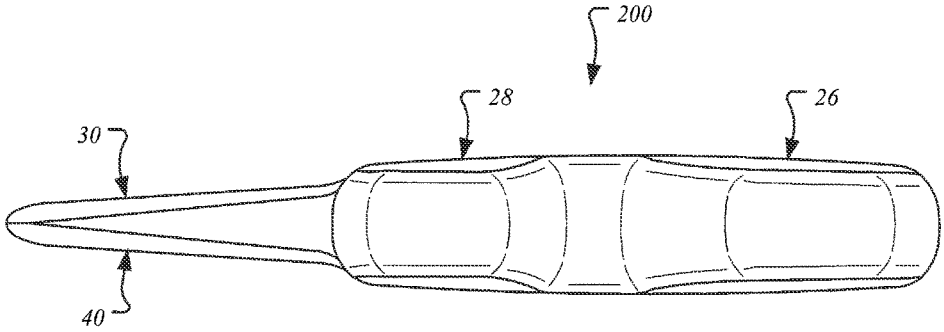
FIG. 18 is a right side view of the second embodiment posture improvement pillow with legs, without an optional pocket.

Referring to FIG. 18, there is illustrated a right side view of the second embodiment of the posture improvement pillow 200 with legs 30 and 40, right upper region 26, right central region 28 and not having a pocket.

Figure 19:
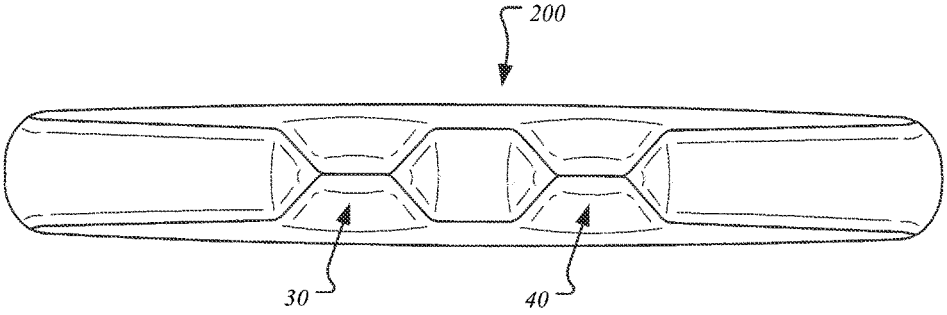
FIG. 19 is a front view of the second embodiment posture improvement pillow with legs, without an optional pocket.

Referring to FIG. 19, there is illustrated a front view of the second embodiment of the posture improvement pillow 200 with legs 30 and 40 and without a pocket.

Figure 20:
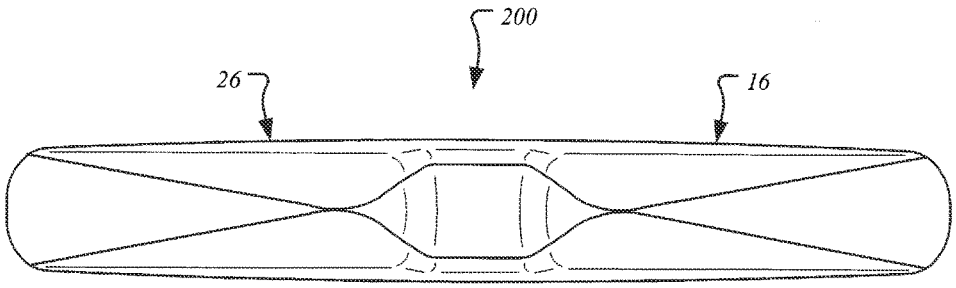
FIG. 20 is a rear view of the second embodiment posture improvement pillow with legs, without an optional pocket.

Referring to FIG. 20, there is illustrated a rear view of the second embodiment of the posture improvement pillow 200 with left upper region 16, right upper region 26, and without a pocket.

Figure 21:
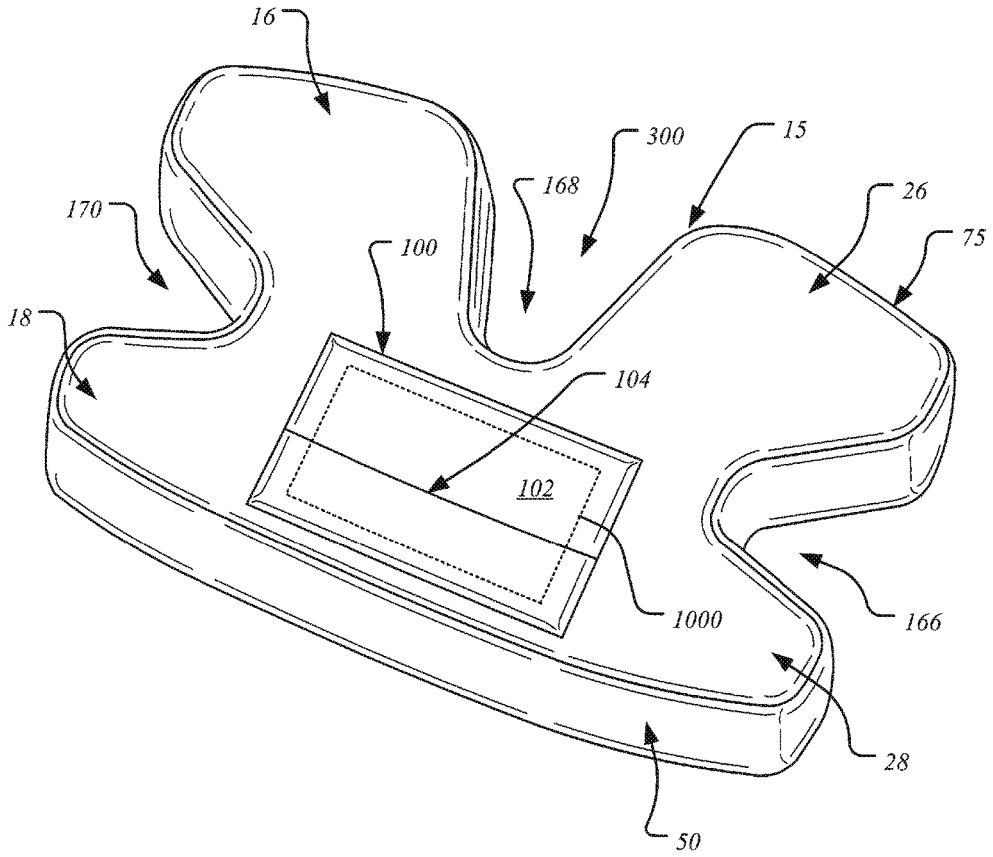
FIG. 21 is a top front perspective view of the third embodiment of the posture improvement pillow without legs, including a pocket.

FIGS. 21 through 28, illustrate the third embodiment of the present invention 300. The third embodiment 300 is comparable to the first embodiment 10 except that the third embodiment does not contain legs 30 and 40. Referring to FIG. 21, there is illustrated a top front perspective view of the third embodiment of the posture improvement pillow 300 with a symmetrically-shaped body 15 having a top surface 12, a bottom surface 14 (see FIG. 22), a left upper region 16, a left central region 18, a right upper region 26, a right central region 28, and main vertical circumferential end wall 50. The main vertical circumferential end wall 50 runs along three contoured cutouts. Beginning from the right portion of the present invention between right central region 28 and right upper region 26 is right contoured cutout 166 having a general U shape. Moving in a counterclockwise direction from right contoured cutout 166 and located between right upper region 26 and left upper region 16 is center contoured cutout 168 having a generally U shape. Left contoured cutout 170 having a generally U shape is located between left upper region 16 and left central region 18.

Figure 22:
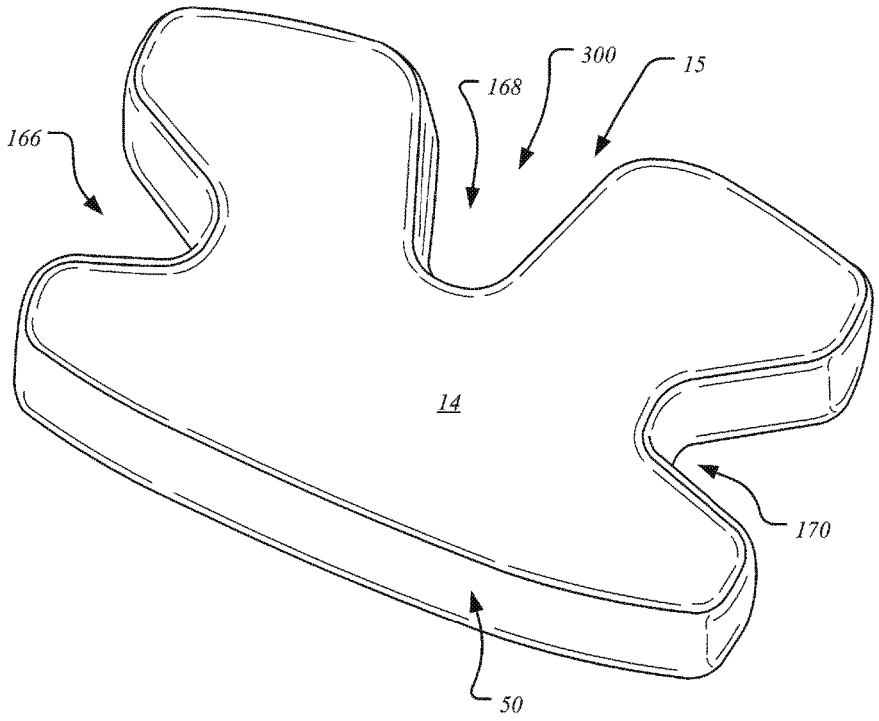
FIG. 22 is a bottom front perspective view of the third embodiment of the posture improvement pillow without legs, including a pocket.

Further referring to FIG. 21, said top surface 12 has a centrally located pocket 100 having a pocket top surface 102 and a pocket opening 104 with said centrally located pocket 100 sized to receive a heating pack to promote healing or a cold pack to reduce swelling. Collectively the cold pack or heat pack is a temperature pack 1000 and not illustrated. Referring to FIG. 22, there is illustrated a front bottom perspective view of the third embodiment.

Figure 23:
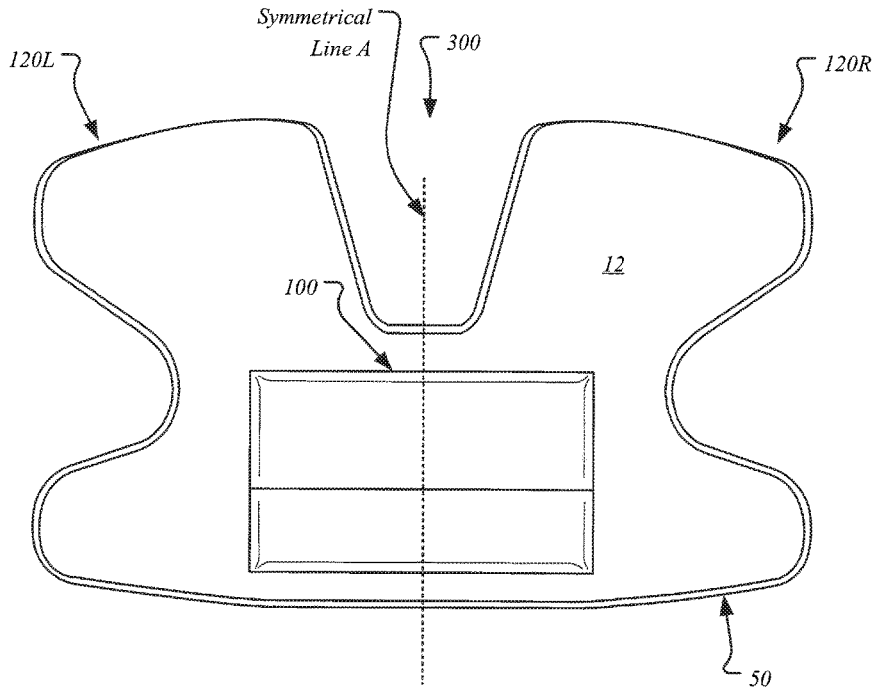
FIG. 23 is a top view of the third embodiment posture improvement pillow without legs, including a pocket.

Referring to FIG. 23, there is illustrated a top view of the third embodiment of the posture improvement pillow 300 having a top surface 12, main vertical circumferential end wall 50, and including pocket 100. Also illustrated in FIG. 23 is symmetrically Line A which splits the left and right portions of the posture improvement pillow 300 into two mirror image sections 120L and 120R. Left section 120L is a symmetrical mirror image of right section 120R.

Figure 24:
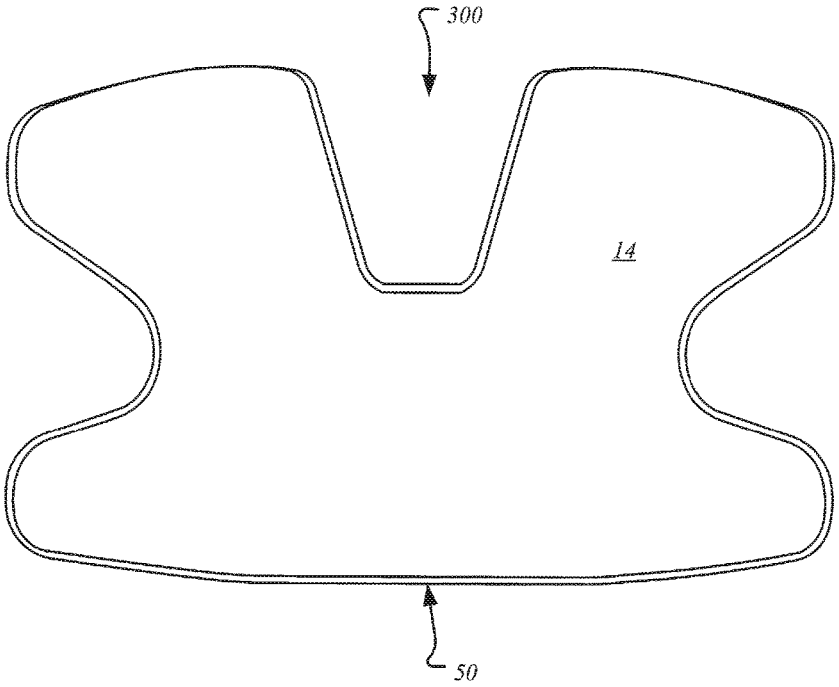
FIG. 24 is a bottom view of the third embodiment of the posture improvement pillow without legs, including a pocket.

Referring to FIG. 24, there is illustrated a bottom view of the third embodiment posture improvement pillow 300 having a bottom surface 14 and main vertical circumferential end wall 50.

Figure 25:
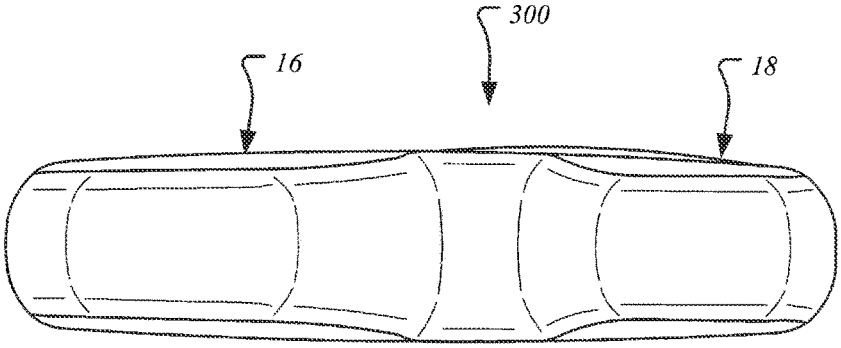
FIG. 25 is a left side view of the third embodiment of the posture improvement pillow without legs, including a pocket.

Referring to FIG. 25, there is illustrated a left side view of the third embodiment of the posture improvement pillow 300, left upper region 16, and left central region 18.

Figure 26:
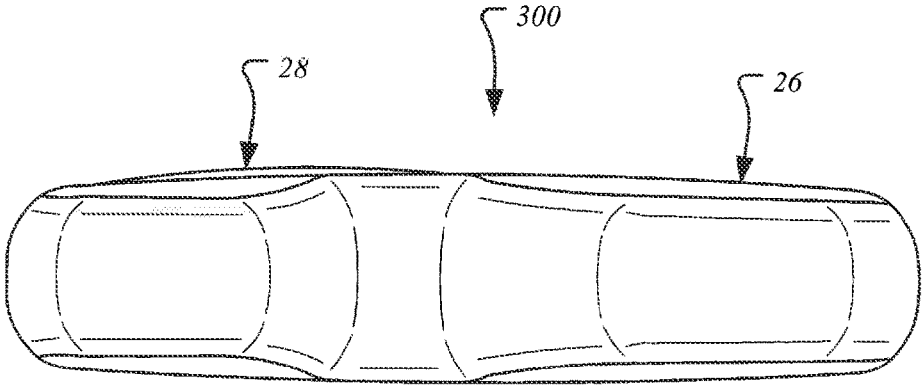
FIG. 26 is a right side view of the third embodiment of the posture improvement pillow without legs, including a pocket.

Referring to FIG. 26, there is illustrated a right side view of the third embodiment posture improvement pillow 300, right upper region 26, and right central region 28.

Figure 27:
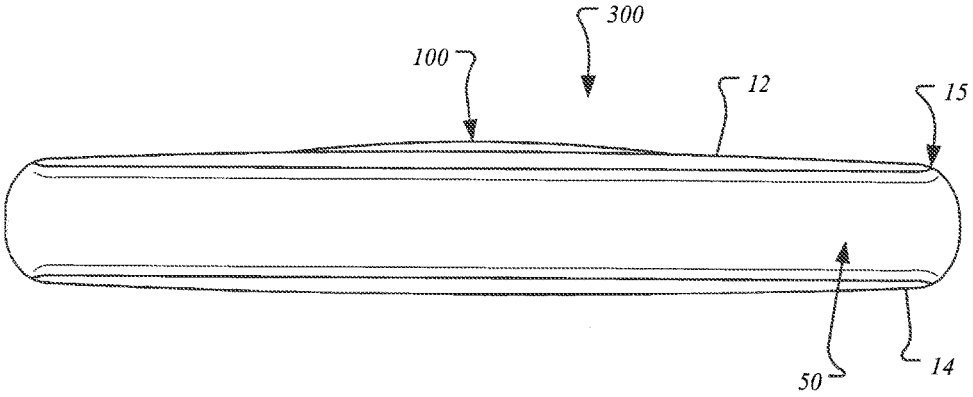
FIG. 27 is a front view of the third embodiment of the posture improvement pillow without legs, including a pocket.

Referring to FIG. 27, is a front view of the third embodiment of the posture improvement pillow 300 having a top surface 12, a bottom surface 14, including pocket 100, and illustrating main vertical circumferential end wall 50 that surrounds symmetrically-shaped body 15.

Figure 28:
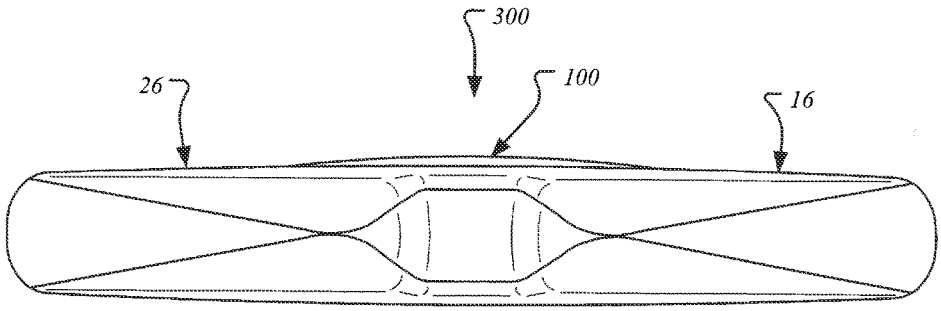
FIG. 28 is a rear view of the third embodiment of the posture improvement pillow without legs, including a pocket.

Referring to FIG. 28, there is illustrated a rear view of the third embodiment posture improvement pillow 300 with pocket 100 and illustrating left upper region 16 and right upper region 26.

Referring to FIGS. 29 to 36, there is illustrated the fourth embodiment 400 of the present invention posture pillion. The fourth embodiment 400 is identical to the third embodiment 300 except there is no pocket 100. Since the remaining parts are identical, the same corresponding numbers have not been added to FIGS. 29 to 36.

Figure 29:
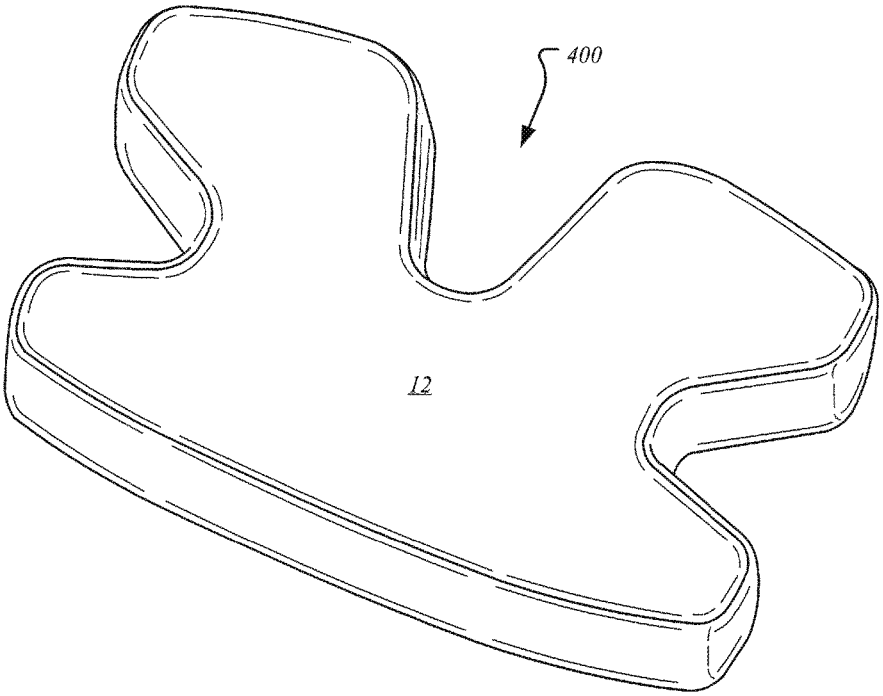
FIG. 29 is a top front perspective view of the fourth embodiment of the posture improvement pillow with legs, without an optional pocket.

Referring to FIG. 29, there is illustrated a top front perspective view of the fourth embodiment of the posture improvement pillow 400 having a top surface 12, however in this embodiment the pocket is removed.

Figure 30:
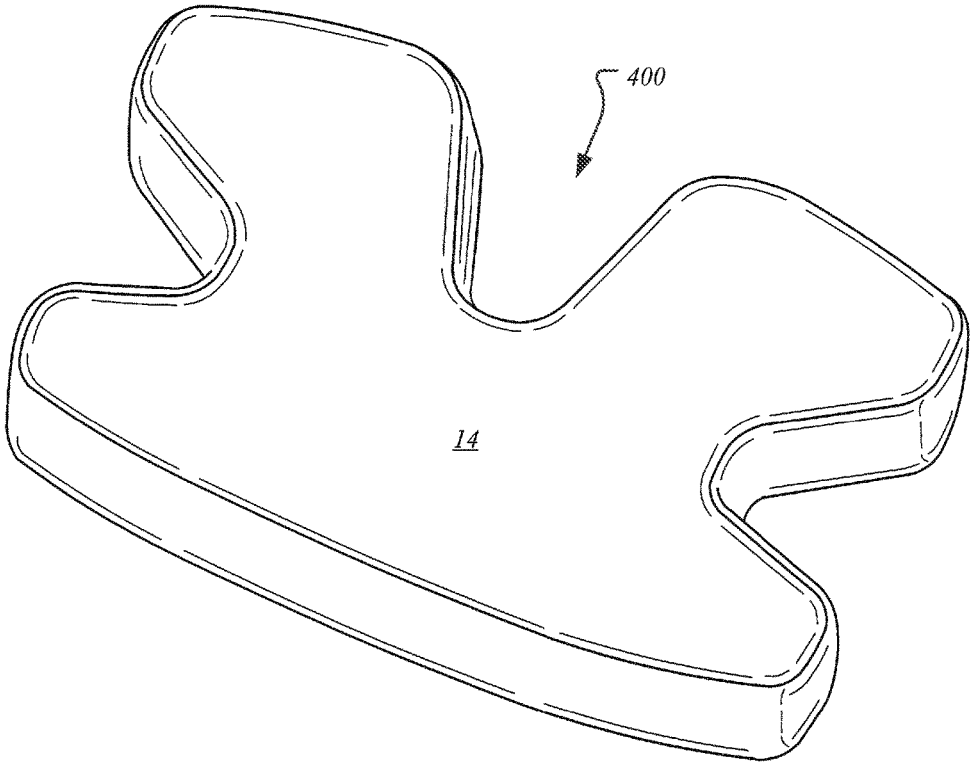
FIG. 30 is a bottom front perspective view of the fourth embodiment of the posture improvement pillow with legs, without an optional pocket.

Referring to FIG. 30, there is illustrated a front bottom perspective view of the posture improvement pillow 400 having a bottom surface 14, however in this embodiment the pocket is removed.

Figure 31:
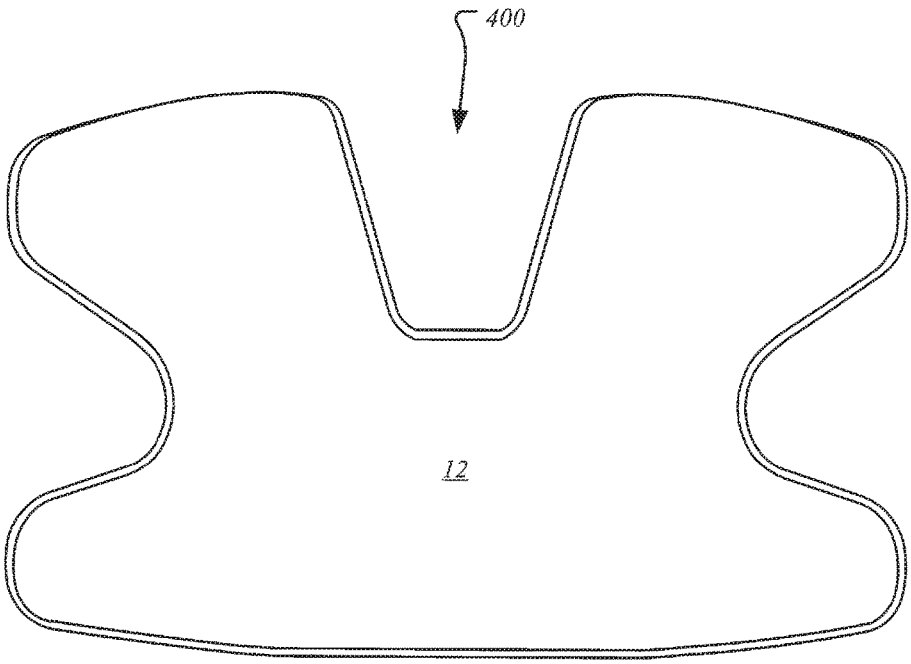
FIG. 31 is a top view of the fourth embodiment of the posture improvement pillow with legs, without an optional pocket.

Referring to FIG. 31, there is illustrated a top view of the fourth embodiment of the posture improvement pillow 400 having a top surface 12.

Figure 32:
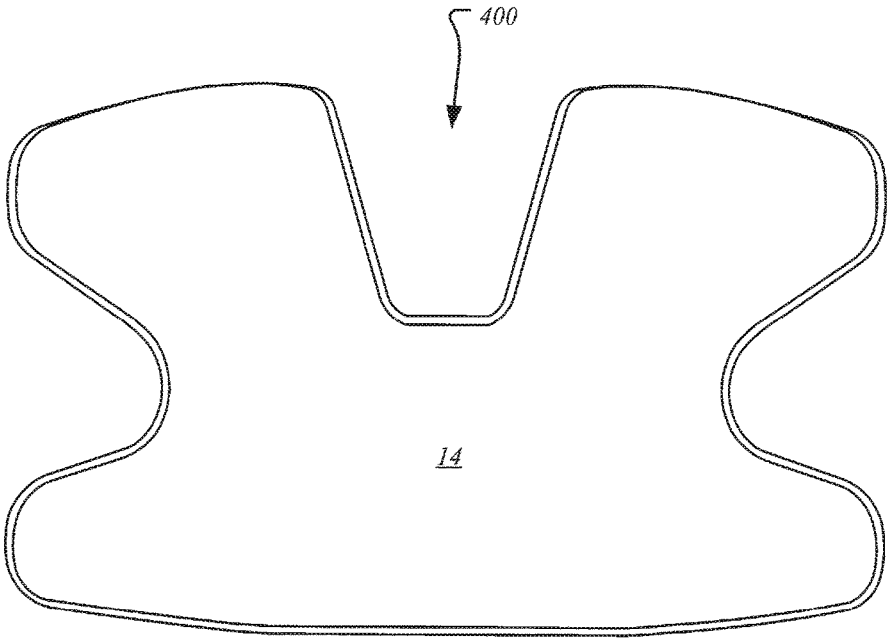
FIG. 32 is a bottom view of the fourth embodiment of the posture improvement pillow with legs, without an optional pocket.

Referring to FIG. 32, there is illustrated a bottom view of the posture improvement pillow 400 having a bottom surface 14.

Figure 33:
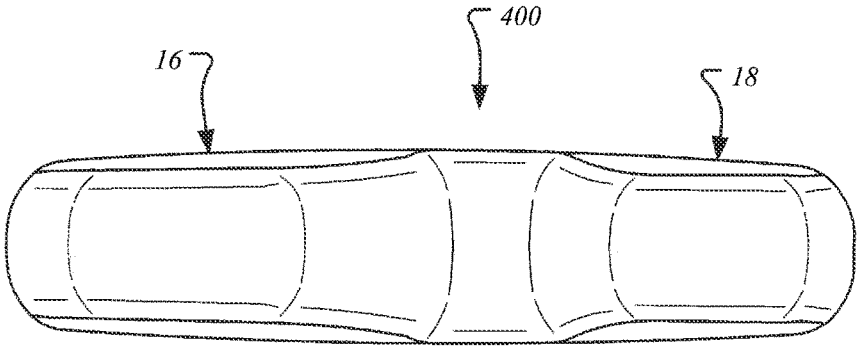
FIG. 33 is a left side view of the fourth embodiment of the posture improvement pillow with legs, without an optional pocket.

Referring to FIG. 33, there is illustrated a left side view of the fourth embodiment of the posture improvement pillow 400 having a left upper region 16, and left central region 18 and not having a pocket.

Figure 34:
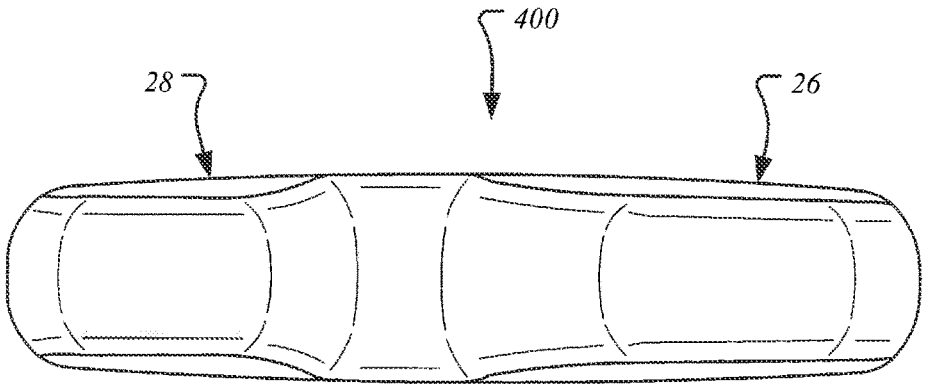
FIG. 34 is a right side view of the fourth embodiment of the posture improvement pillow with legs, without an optional pocket.

Referring to FIG. 34, there is illustrated a right side view of the fourth embodiment of the posture improvement pillow 400 having a left upper region 26, left central region 28 and not having a pocket.

Figure 35:
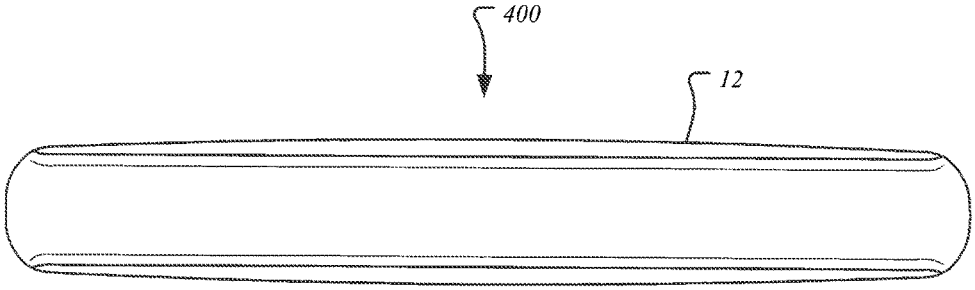
FIG. 35 is a front view of the fourth embodiment of the posture improvement pillow with legs, without an optional pocket.

Referring to FIG. 35, there is illustrated a front view of the fourth embodiment of the posture improvement pillow 400 having a tip surface 12 and without a pocket.

Figure 36:
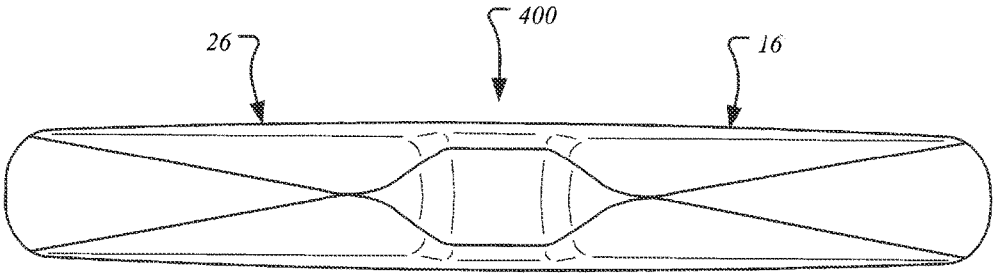
FIG. 36 is a rear view of the fourth embodiment of the posture improvement pillow with legs, without an optional pocket.

Referring to FIG. 36, there is illustrated the fourth embodiment of the posture improvement pillow 400 with left upper region 16, right upper region 26, and without a pocket.

For the embodiments illustrated in FIGS. 21 through 36, the interior is the same as described in FIGS. 9A through 9D and the thickness for the body T1 and legs T2 is the same as a previously described.

Of course the present invention is not intended to be restricted to any particular form or arrangement, or any specific embodiment, or any specific use, disclosed herein, since the same may be modified in various particulars or relations without departing from the spirit or scope of the claimed invention hereinabove shown and described of which the apparatus or method shown is intended only for illustration and disclosure of an operative embodiment and not to show all of the various forms or modifications in which this invention might be embodied or operated.

What is claimed is:

1. A pillow comprising:

(a) a body having a top surface, a flat bottom surface, a left upper region, a left central region, a right upper region, a right central region, a left leg, a right leg, and a main vertical end wall that connects to said top surface at a top edge and connects to said bottom surface at a bottom edge;

(b) said symmetrically shaped body having six contoured cutouts formed from said main vertical end wall connecting said left upper region, said left central region, said right upper region, said right central region, said left leg, and said right leg;

(c) said left leg and said right leg formed from said main vertical end wall transitioning from a thickness T1 to a thickness T2;

(d) a U-shaped first contoured cutout between said left leg and said right leg;

(e) a second contoured cutout between said right leg and said right central region, said right leg perpendicular to said right central region;

(f) a third contoured cutout between said right central region and said right upper region;

(g) a U-shaped fourth contoured cutout between said right upper region said left upper region;

(h) a fifth contoured cutout between said left upper region and said left central region;

(i) a sixth contoured cutout between said left central region and said left leg perpendicular to said left central region;

(j) said top surface having a centrally located pocket with said centrally located pocket sized to receive a temperature pack;

(k) said body is symmetrically shaped around a central axis;

(l) said bottom edge extends a perimeter of said pillow; and (m) said third contoured cutout has a shape that is a mirror image opposite to the shape of said fifth contoured cutout and said second contoured cutout has a shape that is a mirror image opposite to the shape of said sixth contoured cutout;

(n) wherein each contoured cutout is sized and shaped to support a user's neck.

2. The pillow in accordance with claim 1, wherein said first thickness is between one inch and five inches.

3. The pillow in accordance with claim 1, further: including an inner material that is made from components selected from a group consisting of: feathers, foam, synthetic foam, gel, latex, polyester, visco-elastic material, and memory foam.

4. The pillow in accordance with claim 1, wherein said left upper region is larger than said left central region and said right upper region is larger than said right central region.

5. The pillow in accordance with claim 1, wherein said top surface is equal in size to said bottom surface.

6. A pillow comprising:

(a) a body having a top surface, a flat bottom surface, a left upper region, a left central region, a right upper region, a right central region, a left leg, a right leg, and a main vertical circumferential end wall;

(b) said body having six contoured cutouts formed from said main vertical circumferential end wall connecting said left upper region, said left central region, said right upper region, said right central region, said left leg, and said right leg;

(c) said left leg and said right leg formed from said main vertical circumferential end wall transitioning from a thickness T1 to a thickness T2;

(d) a first contoured cutout between said left leg and said right leg;

(e) a second contoured cutout between said right leg and said right central region, said right leg perpendicular to said right central region;

(f) a third contoured cutout between said right central region and said right upper region;

(g) a fourth contoured cutout between said right upper region and said left upper region;

(h) a fifth contoured cutout between said left upper region and left central region;

(i) a sixth contoured cutout between said left central region and said left leg perpendicular to said left central region, (j) said top surface having a centrally located pocket with said centrally located pocket sized to receive a temperature path;

(k) said third contoured cutout has a shape that is a mirror image opposite to the shape of said fifth contoured cutout and said second contoured cutout has a shape that is a mirror image opposite to the shape of said sixth contoured cutout;

(l) said body is symmetrically shaped around a central axis; and (m) said bottom edge extends a perimeter of said pillow;

(n) wherein said bottom surface extends equidistant to a horizontal plane at each and every location along said bottom surface;

(o) wherein each contoured cutout is sized and shaped to support a user's neck.

7. The pillow in accordance with claim 6, wherein said first thickness is between one inch and five inches.

8. The pillow in accordance with claim 6, further including an inner material that is made from components selected from a group consisting of: feathers, foam, synthetic foam, gel, latex, polyester, visco-elastic material, and memory foam.

9. The pillow in accordance with claim 6, wherein said left upper region is larger than said left central region and said right upper region is larger than said right central region.

10. The pillow in accordance with claim 6, wherein said top surface is equal in size to said bottom surface.

11. A pillow comprising:

(a) a body having a top surface, a flat bottom surface, a left upper region, a left central region, a right upper region, a right central region, a left leg, a right leg, and a main vertical circumferential end wall;

(b) said body having six contoured cutouts formed from said main vertical circumferential end wall connecting said left upper region, said left central region, said right upper region, said right central region, said left leg, and said right leg;

(c) said left leg and said right leg formed from said main vertical circumferential end wall transitioning from a thickness T1 to a thickness T2 at;

(d) a first contoured cutout between said left leg and said right leg;

(e) a second contoured cutout between said right leg and said right central region, said right leg perpendicular to said right central region;

(f) a third contoured cutout between said right central region and said right upper region;

(g) a fourth contoured cutout between said right upper region and said left upper region;

(h) a fifth contoured cutout between said left upper region and left central region;

(i) a sixth contoured cutout between said left central region and said left leg perpendicular to said left central region;

(j) said top surface having a pocket sized to receive a temperature pack;

(k) said body is symmetrically shaped around a central axis;

(l) said bottom edge extends a perimeter of said pillow; and (m) said third contoured cutout has a shape that is a mirror image opposite to the shape of said fifth contoured cutout and said second contoured cutout has a shape that is a mirror image opposite to the shape of said sixth contoured cutout.

12. The pillow in accordance with claim 11, wherein said first thickness is between one inch and five inches.

13. The pillow in accordance with claim 11, further including an inner material that is made from components selected from a group consisting of: feathers, foam, synthetic foam, gel, latex, polyester, visco-elastic material, and memory foam.

14. The pillow in accordance with claim 11, wherein said left upper region is larger than said left central region and said right upper region is larger than said right central region.

15. The pillow in accordance with claim 11, wherein said top surface is equal in size to said bottom surface.

* * * * *